US008844723B2

(12) United States Patent
Paliotta et al.

(10) Patent No.: US 8,844,723 B2
(45) Date of Patent: Sep. 30, 2014

(54) CHILD RESISTANT PACKAGE HAVING PIVOTING COMPONENT

(75) Inventors: Michael Paliotta, Horseheads, NY (US); George Howell, Elmira, NY (US)

(73) Assignee: F.M. Howell & Company, Elmira, NY (US)

( * ) Notice: Subject to any disclaimer, the term of this patent is extended or adjusted under 35 U.S.C. 154(b) by 561 days.

(21) Appl. No.: 12/837,884

(22) Filed: Jul. 16, 2010

(65) Prior Publication Data

US 2012/0012498 A1 Jan. 19, 2012

(51) Int. Cl.
*B65D 83/04* (2006.01)
*A61J 1/03* (2006.01)

(52) U.S. Cl.
CPC ..... *A61J 1/035* (2013.01); *B65D 2215/00* (2013.01); *B65D 83/0463* (2013.01)
USPC ..... 206/531; 206/528; 206/461

(58) Field of Classification Search
USPC ..... 206/528–529, 531–532, 534.1, 206/538–539, 461–462, 468–470, 1.5, 828
See application file for complete search history.

(56) References Cited

U.S. PATENT DOCUMENTS

| | | | | |
|---|---|---|---|---|
| 5,954,202 | A * | 9/1999 | Mellon | 206/462 |
| 6,659,280 | B2 * | 12/2003 | Paliotta et al. | 206/531 |
| 6,675,972 | B2 * | 1/2004 | Patterson | 206/531 |
| 6,789,677 | B2 * | 9/2004 | Maietta | 206/536 |
| 6,896,138 | B2 * | 5/2005 | Rock et al. | 206/531 |
| 7,000,768 | B2 * | 2/2006 | Morita et al. | 206/531 |
| 7,690,511 | B2 * | 4/2010 | Arnold et al. | 206/532 |
| 2003/0006163 | A1 * | 1/2003 | Patterson | 206/531 |
| 2007/0056876 | A1 * | 3/2007 | Jones | 206/531 |

* cited by examiner

*Primary Examiner* — Anthony Stashick
*Assistant Examiner* — Robert Poon
(74) *Attorney, Agent, or Firm* — Arent Fox LLP

(57) ABSTRACT

A multi-layered blister package includes a first panel having at least one blister pocket receiving aperture defined therein, wherein a blister pocket protrudes through the at least one blister pocket receiving aperture and retains an article therein. A second panel has at least one exit aperture defined therein, wherein the at least one exit aperture aligns with the at least one blister pocket receiving aperture when the first panel is disposed over the second panel. A third panel having at least one intermediate aperture defined therein, wherein the at least one intermediate aperture aligns with and is between the at least one exit aperture and the at least one blister pocket receiving aperture when the third panel is pivoted to a first position.

20 Claims, 7 Drawing Sheets

CHILD RESISTANT PACKAGE HAVING PIVOTING COMPONENT

BACKGROUND OF THE INVENTION

1. Field of the Invention

This invention relates to a child resistant blister package having a pivoting panel. More particularly, the invention relates to a plurality of panels joined together, with a first panel having a plurality of apertures defined therein and which are opposite corresponding apertures defined in layered second and third panels. Moreover, the third panel is disposed between the first and second panels, and is pivotable relative to the first and second panels, wherein the apertures in the third panel align with the apertures of the first and second panels when the third panel is pivoted.

2. Description of Related Art

It is common practice to use blister packages to package small solid articles or products which may be dispensed from the package by applying pressure to the blister to force the article or product from an individual blister or capsule through a rupturable membrane. Since this type of packaging is typically used for marketing medicines, the invention will be referred to herein with respect to a package particularly suitable for such use, but it should be understood that the package may be used for other products as well, such as food products, like candy, etc., or non-consumable articles, like batteries for hearing aides and the like. Recently, a substantial effort has been directed toward providing packaging that contains sufficient impediments to prevent children from easily opening the package and gaining access to the package articles or products while still providing adults with easy access to the articles or products contained therein.

For example, U.S. Pat. No. 6,675,972 to Patterson discloses a childproof blister packaging that includes a first portion 1 with a second portion 2 and a third portion 3 extending from two opposite sides of the first portion 1. See FIG. 1. The first portion 1 includes apertures 10 defined therein that align with apertures 16 of the second portion 2 and apertures 18 of the third portion 3 when the second portion 2 and the third portion 3 are folded over the fold lines A, B. See FIG. 2. Before folding the second portion 2 and the third portion B, a blister pack 22 is placed on a surface of the first portion 1. The second portion 2 includes a moveable closure 14 that is moveable to block access to the outlet. The third portion 3 includes a slotted aperture allowing a user to insert an elongated device to move the moveable closure 14. See FIG. 5.

However, Patterson does not appear to teach a pivotable intermediate panel that blocks and or allows access to the outlet, thereby requiring individual actuation of each moveable member.

United States Patent Application Publication Number 2009/0071863 to Arnold et al. discloses a blister package having a carrier tab 29 that is pivoted to allow a pill to be released through an exit port 40. The package includes a cover sheet 23 having an aperture 22 for receiving a blister 19. A blister laminate 14 is pressed between the cover sheet 12 and a backing 18. The blister laminate 14 includes carrier tabs 29 attached to necks 30 angled away from a gap 34. Each neck 30 further includes the blister 19 containing a pill. The aperture 22 of the cover sheet 12 is sized such that when a carrier tab 29 is in a default position, the blister 19 is not aligned with the exit port 41. See FIGS. 2-4. By applying force to the lip 26, the user of the device tears a connection mechanism 32 and pivots the carrier tab 29 so that the blister 19 is aligned with exit port 41. See FIGS. 5 and 6. By pushing down on the pill and rupturing a rupturable layer 16, the pill exits through the exit port 41. See FIG. 7.

However, Arnold does not appear to teach a pivotable intermediate panel that blocks or allows access to the outlet, thereby requiring individual actuation of each tab.

U.S. Pat. No. 717,460 to Smith discloses a double cover box 1 having a cover 2 and an upper flap 3. A hole 4 is formed in the cover 2 and a corresponding hole 5 is formed in the upper flap 3 so that when the upper flap 3 is closed, the holes 4, 5 are aligned. A cover plate 6 disposed between the cover 2 and the upper flap 3 is attached to the cover 2 at a single point 7, thereby allowing the cover plate 6 to pivot around the point 7. The cover plate 6 further includes a thumb piece 8 protruding from the surface of the cover plate and extends through a curved guide 11 formed through the upper flap 3. By moving the protruding thumb piece 8 along the curved guide 11, the user is able to pivot the cover plate, thereby opening and closing the communication between holes 4, 5. See FIGS. 2, 5, and 6. However, Smith does not teach a blister package.

U.S. Pat. No. 605,351 to Smith discloses a display card comprising a front cover, a back cover (d), and a center card (a). All three cards pivot relative to each other around a pivot point (e). The center card (a) includes multiple orifices (b) for receiving merchandise. By pivoting the front cover and back cover (d) the orifices (b) are exposed. However, Smith does not teach a blister package.

SUMMARY OF THE INVENTION

It is an aspect of this invention to at least overcome the above-discussed drawbacks of the conventional child-resistant packages and dispensers.

Another aspect of this invention provides a unique child-resistant blister package that is child resistant and senior citizen friendly.

Yet another aspect of this invention provides a multi-layered child resistant blister package that includes a pivoting panel located between a first panel and a second panel, wherein apertures defined in the pivoting panel align with apertures defined in the first and second panels once the pivoting panel is pivoted relative to the first and second panels. Hereinafter, the following terms are interchangeably used to indicate the joining of the various panels and other structural components: adhered, affixed, attached, bonded, fixed to, glued, heat sealed, married, sealed together, stuck together, welded, and the like.

According to another aspect of this invention, the package includes at least three overlapping panels separated from each other by two fold lines. The package can be manufactured from a material selected from any one of paperboard, plastic and a combination of both, wherein the material may also be tear-resistant.

A cover may also be provided that contains indicia that would be ornamental and/or informative in nature.

BRIEF DESCRIPTION OF THE DRAWINGS

Other aspects and features of this invention will be better understood from the following description, with reference to the accompanying drawings, wherein.

DETAILED DESCRIPTION OF THE PREFERRED EMBODIMENTS

Figure 1:
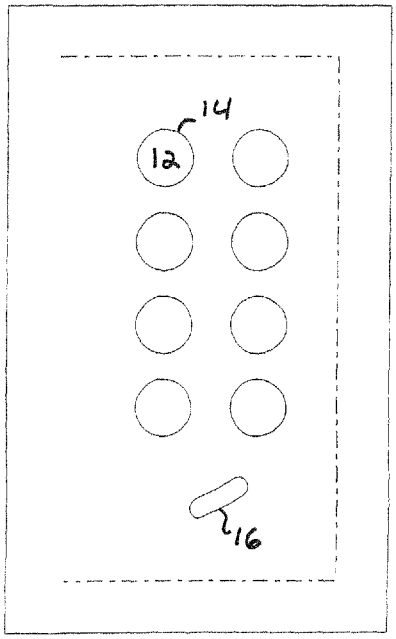
FIG. 1 is a top view of a first panel of a disassembled package according to a preferred embodiment of the invention.
Figure 2:
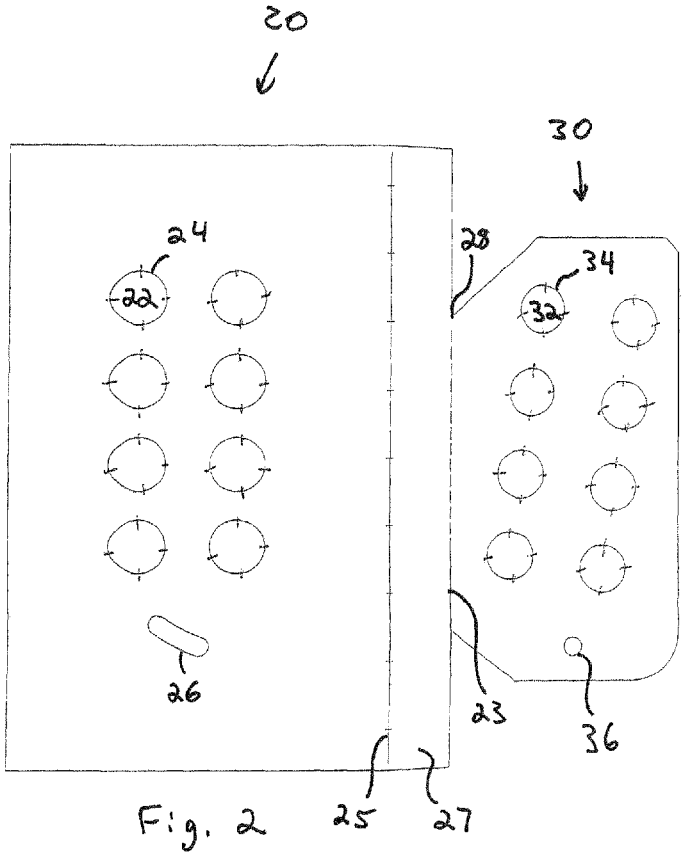
FIG. 2 is a top view of a second and a third panel of the disassembled package of FIG. 1.
Figure 3:
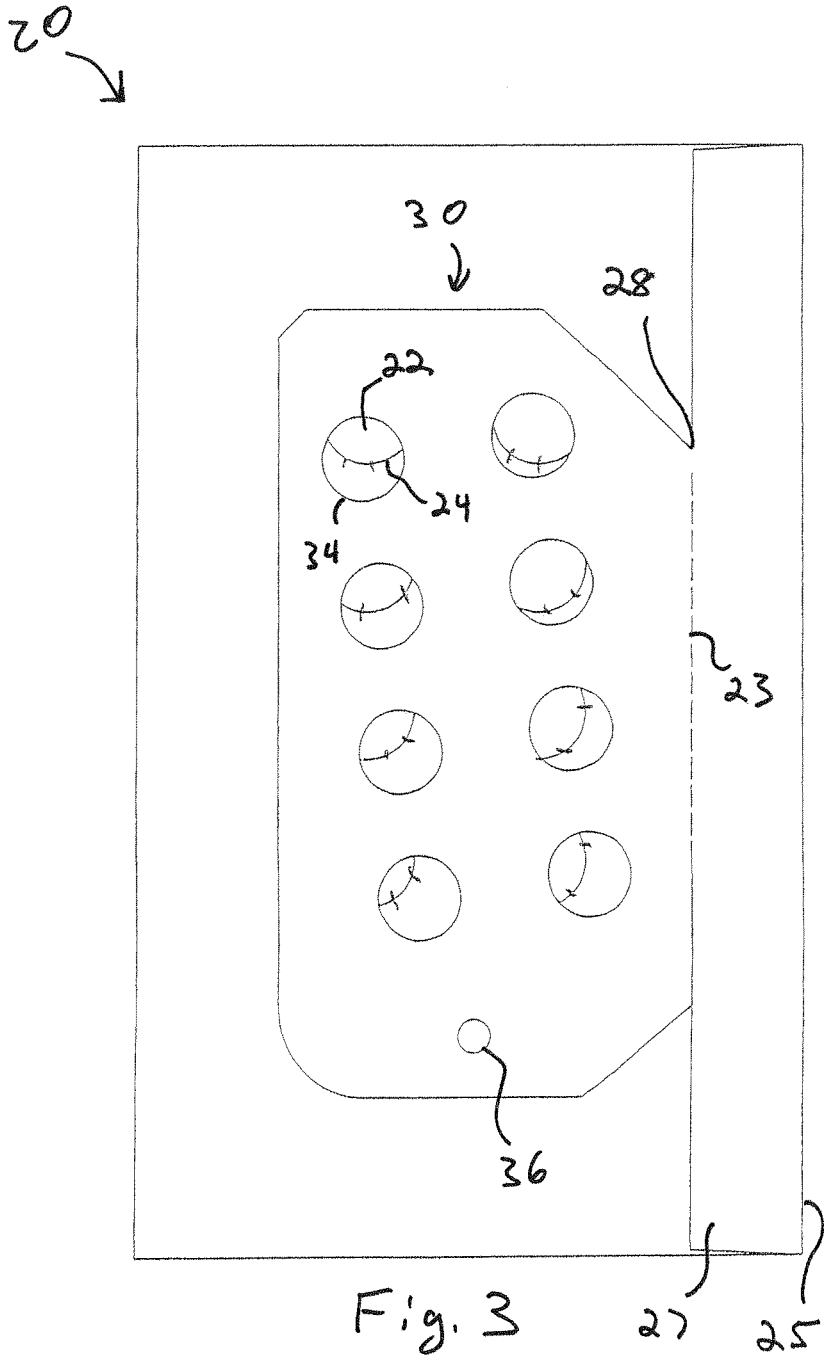
FIG. 3 is a top view of the second panel and the third panel of the package of FIG. 1, in a partially assembled state.

Referring to FIGS. 1 to 3, the package 1 is formed from a flat, substantially rectangular-shaped first panel 10, second panel 20 and third panel 30, each of the panels being preferably manufactured from paperboard. However, it is within the scope of this invention to use any suitable material well known or later developed in the art, such as, for example, paper, plastic, metal, natural or man-made, and the like. Furthermore, although not illustrated but well understood in the art, it is within the scope of this invention to use any suitable geometric shape, such as, for example, square, trapezoidal, circular, oval, and the like to form the package 1. Moreover, it is within the scope of the invention for each or any of the panels 10, 20, 30 to be composed of multiple pieces.

Referring to FIG. 1, the package 1 includes a first panel 10. The first panel 10 is configured to coincide and overlap a second panel 20, discussed in detail below. The first panel 10 includes a plurality of blister pocket receiving apertures 12 that may correspond (i.e., equal) to a number of exit apertures 22 in the second panel 20. However, it is within the scope of the invention to have a number of exit apertures 22 that may be less than a number of the blister pocket receiving apertures 12 such that multiple, i.e., at least two, articles may be removed from the package 1 from a single exit aperture 22. The blister pocket receiving apertures 12 typically will contain blister packaging (not shown) that is well known in the art and is made from such materials as, for example only, clear plastic, foil, or the like. It should be noted that blister packaging is well known in the art and includes a backing that may include, but does not require, a rupturable membrane through which each article passes when being removed from the package 1. As shown in FIG. 1, in a first preferred embodiment, the perimeter 14 of the blister pocket receiving apertures 12 are formed by a continuous cut line, and thus, are always fully exposed. The first panel 10 further includes a first guide slot 16. In a preferred embodiment the guide slot is arcuate. It is within the scope of the invention however that the guide slot 16 may be configured to have any suitable shape including curved, angled, or any orientation that is capable of facilitating a pivoting motion, which is described in further detail below. For example, a parallel, perpendicular, or angled orientation relative to a side of the package 1 is to be considered as being within the scope of the invention and a rectangular, square, or triangle shape is suitable. While any shape, curve, angle, or orientation of the guide slot 16 is acceptable, in a preferred embodiment, the guide slot 16 is angled with respect to the sides of the first and second panels 10, 20. The operation of the guide slots are discussed in detail below.

Referring to FIG. 2, the package 1 includes a second panel 20. A plurality of exit apertures 22 are formed in the second panel 20. In a preferred embodiment, the exit apertures or holes 22 have a perimeter 24. Alternatively, in another preferred embodiment, the exit apertures 22 may have a detachable body portion defined by non-continuous cut lines which provide additional tamper protection. Any suitable alternative to non-continuous cut lines are acceptable to provide the additional tamper protection if the alternatives allow the exit apertures 22 to remain closed or covered until a user of the package applies pressure to break through the second panel 20. For example, the detachable body portion can be defined by nicked lines, perforated lines, a hinged circle, two or more crossing non-continuous lines, or any combination thereof. Although two rows of four exit apertures 22 are shown being positioned relatively in the center of the second panel 20, it is within the scope of this invention to place any number of exit apertures 22, anywhere on the first panel 20 so long as the location is remote from the outer perimeter of the second panel 20, i.e., not bordering any portion of the perimeter of the second panel 20 and in as many rows, e.g., three or more, or little, i.e., only one row, as necessary. For example only, there could be one row, or three or more rows of any number of exit apertures 22 provided on the second panel 20.

The second panel 20 further includes a second guide slot 26. As with the first guide slot 16, in a preferred embodiment, the second guide slot 26 is arcuate in configuration. However, the second guide slot 26 may be configured to have any suitable shape and may be oriented relative to the side of the package 1 in any manner such as angled, perpendicular or parallel relative to the sides that is capable of facilitating pivoting motion of the third panel 30, which is described in further detail below. In a preferred embodiment, of the second guide slot 26 is configured to have a shape that corresponds to the shape of the first guide slot 16 to allow a relatively smooth pivoting motion of the third panel 30. However, it is within the scope of the invention that the shapes of the guide slots 16, 26 do not directly correspond as long as the third panel 30 is capable of pivoting between the first and second panels 10, 20. The second guide slot 26 and the first guide slot 16 are positioned to align with each other when the first panel 10 is placed over the second panel 20. When aligned, a longitudinal axis of the first guide slot 16 intersects a longitudinal axis of the second guide slot 16.

Referring to FIG. 3, the package 1 includes a third panel 30. The third panel 30 is separated from the second panel 20 by a non-continuous cut line 23 and is configured to coincide and overlap the second panel 20 by folding part of the second panel 20 over a fold line 25. A plurality of intermediate apertures 32 are defined in the third panel 30. In a preferred embodiment the intermediate apertures or holes 32 have a perimeter 34. Alternatively, in another preferred embodiment, the intermediate apertures 32 may have a detachable body portion defined by non-continuous cut lines which provide additional tamper protection. As with the exit apertures 22, any suitable alternative to non-continuous cut lines are acceptable to provide the additional tamper protection if the alternatives allow the intermediate apertures 32 to remain covered until a user of the package applies pressure to break through the third panel 30. For example, the detachable body portion can be defined by nicked lines, perforated lines, a hinged circle, two or more crossing non-continuous lines, or any combination thereof.

Figure 4:
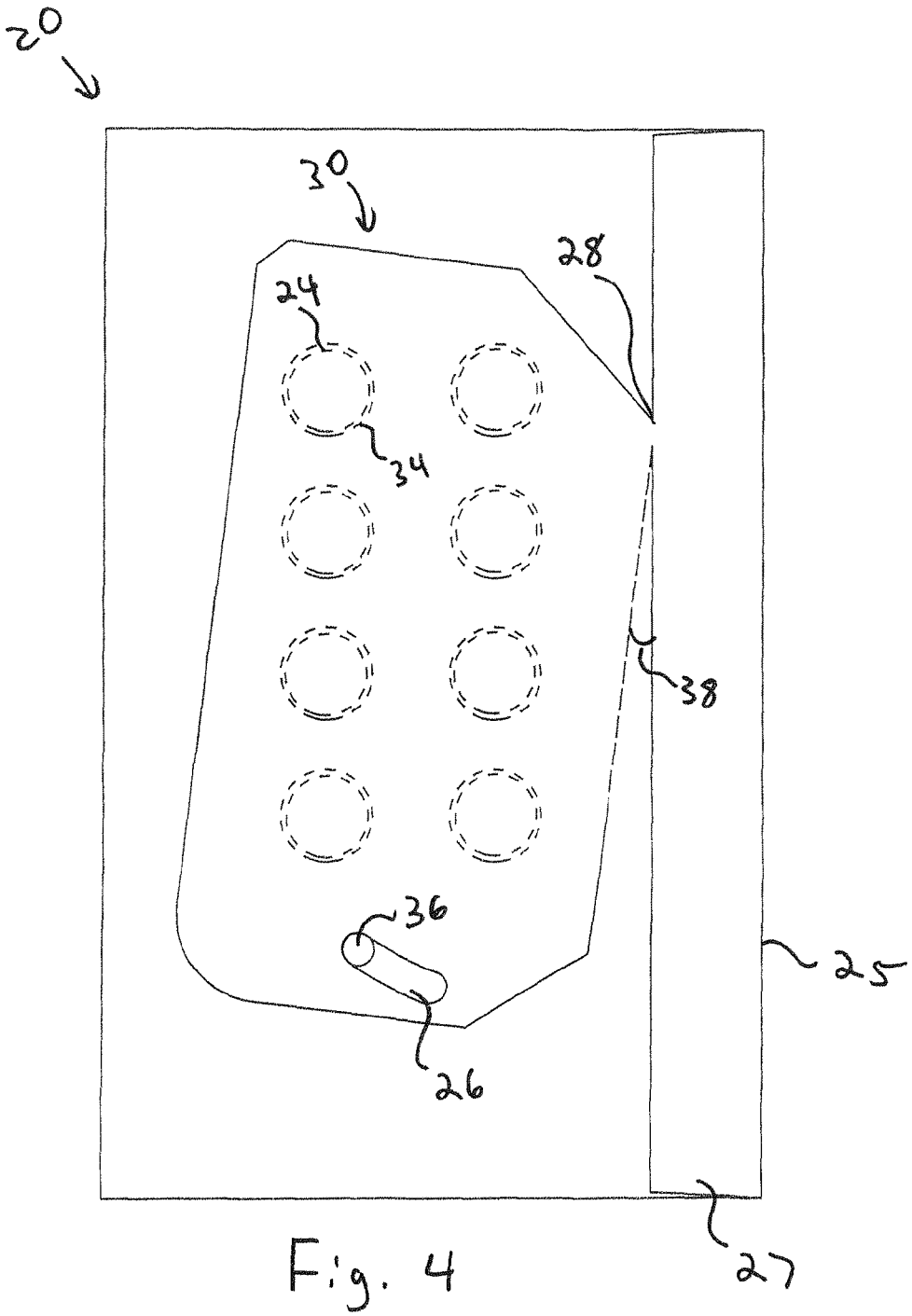
FIG. 4 is a top view of the second panel and the third panel of the package of FIG. 1, in partially assembled state and in a pivoted position.
Figure 5:
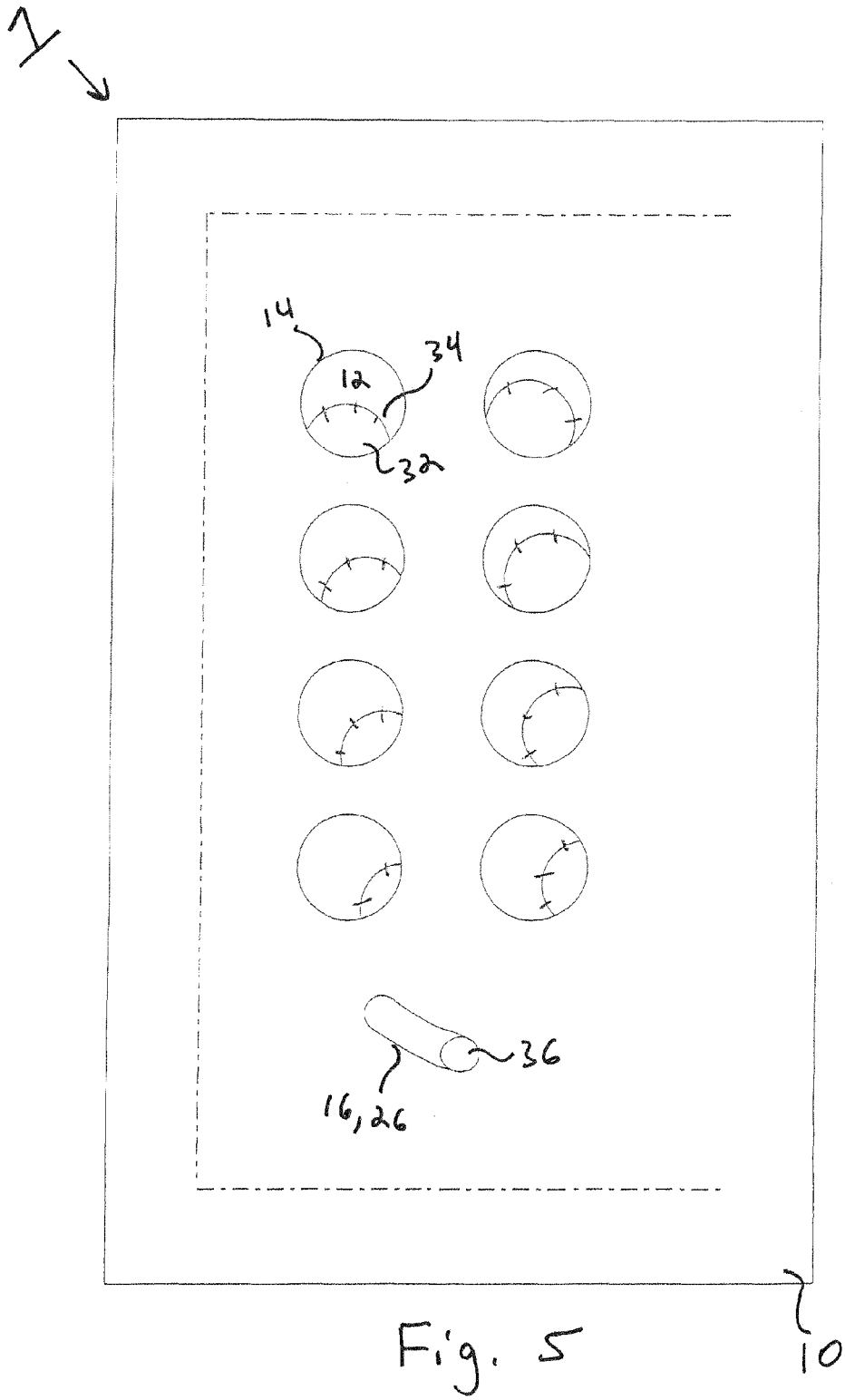
FIG. 5 is a top view showing the first panel, the second panel, and the third panel of the package of FIG. 1, in an assembled state and in a non-pivoted position.

The number of intermediate apertures 32 may correspond to the number of exit apertures 22 in the second panel 20 and the number of blister pocket receiving apertures 12 in the first panel 10. However, it is within the scope of the invention to have a number of intermediate apertures 32 that may be less than a number of the blister pocket receiving apertures 12 such that multiple, i.e., at least two, articles may pass through a single intermediate aperture 32. The third panel further includes a third guide slot or an actuation guide slot 36. The actuation guide slot 36 is formed to fit within, but have a smaller area than, the first guide slot 16 and the second guide slot 26. In a preferred embodiment, the actuation guide slot 36 does not have an arcuate shape. As shown in FIGS. 2-5, the actuation guide slot 36 may have a circular shape. However, it is within the scope of the invention that the actuation guide slot 36 may have any suitable shape as long as the third panel 30 is capable of pivoting in the manner described below. A suitable shape depends upon the shape of the first and second guide slots 16, 26. For example, in the embodiment shown in FIGS. 2-5, the actuation guide slot 36 is a circle having an outer diameter corresponding to the perimeter of the first and second guide slots 16, 26. As shown in FIGS. 4 and 5 the outer diameter of the circle may be substantially equal to the width of the first and second guide slots 16, 26. When the second panel 20 is folded along fold line 25, the third panel 30, along with a hinge member 27 of the second panel 20, is positioned upon a surface of the second panel 20 such that the actuation guide slot 36 aligns with a proximal end of the second guide slot 26. When aligned, a longitudinal axis of the actuation guide 36 slot intersects a longitudinal axis of the first guide slot 16 and a longitudinal axis of the second guide slot 26.

A blister package (not shown) is affixed to the first panel 10 such that each blister or pocket passes through a corresponding blister pocket receiving aperture 12. Referring to FIG. 3, a hinge member 27 of the second panel 20, along with the attached third panel 30 is folded over the fold line 25 and onto a front surface of the second panel 20 such that the intermediate apertures 32 of the third panel 30 partially align with a corresponding exit apertures 22. The hinge member 27 is a portion of the second panel 20 that is connected to the third panel 30 and once folded onto the surface of the second panel 20, the hinge member 27 functions as an anchor for the pivoting third panel 30. The hinge member 27 may be affixed to or otherwise joined to the surface of the second panel 20. The partial alignment of the exit apertures 22 and the intermediate apertures 32 occurs when the third panel 30 is in a non-pivoted position. As shown in FIG. 3, the non-pivoted position is when third panel 30 is aligned with the hinge member 27 along the non-continuous cut line 23.

Referring to FIG. 5, the first panel 10 having the blister package (not shown) affixed thereto is then positioned on the third panel 30 and the second panel 20, such that the blister pocket receiving apertures 12 and exit apertures 22 align. Thus, because the blister pocket receiving apertures 12 are aligned with the exit apertures 22 and the exit apertures are partially aligned with the intermediate apertures, the blister pocket receiving apertures 12 are also partially aligned with the intermediate apertures 32. The term "partially aligned" is meant to encompass any degree of alignment wherein the centers of the apertures are not aligned to the extent that an article would not be able to pass through the apertures. The term "aligned" is meant to encompass any degree of alignment wherein the centers of the apertures are aligned sufficiently enough to allow an article to pass through the apertures. Furthermore, when the first panel 10 is placed on top of the folded third panel 30, the first guide slot 16 aligns with the second guide slot 26 and the actuation guide slot 36, such that the actuation guide slot 36 is disposed between the first and second guide slots 16, 26 and at a proximal end of both guide slots 16, 26. After the first panel 10 is positioned on top of the third panel 30 and the second panel 20, the first panel 10 may be bonded or otherwise joined to the second panel 20 along the periphery of the panels 10, 20.

FIG. 4 illustrates the third panel 30 in a fully pivoted position. The first panel 10 has been omitted from FIG. 4 for clarity. After folding the third panel 30 onto the surface of the second panel 20, but before joining the first panel 10 to the second panel, the third panel 30 is substantially detached from the second panel by tearing along the non-continuous line 23, thereby creating a pivot point 28. In a preferred embodiment, only a small portion of the non-continuous line 23 remains, thereby allowing the third panel 30 to pivot along the pivot point 28 when force is applied at one end of the third panel. It is within the scope of the invention, however, that the third panel 30 may be separated from the hinge member 27 by any amount necessary to allow the intermediate apertures 32 to align with the blister pocket receiving apertures 12 and the exit apertures 22. The amount of separation necessary would directly correlate with how far away the intermediate apertures 32 are from alignment with the blister pocket receiving apertures 12 and the exit apertures 22 when the third panel is in the non-pivoted position. However, because the first and second guide slots 16, 26 limit the extent to which the third panel 30 may be pivoted, the amount of separation may exceed the amount necessary to align the apertures 12, 22, 32.

As mentioned above, when the third panel 30 is the non-pivoted position, the actuation guide slot 36 is located at a proximal end of the first and second guide slots 16, 26. The configuration of the guide slots 16, 26, and 36 allows for a small diameter insertion device, for example, a pencil tip, to pass completely through the package 1 via the alignment of the first guide slot 16 with the second guide slot 26 and the actuation guide slot 36. Because the actuation guide slot 36 has a smaller area than the first and second guide slots 16, 26, if the insertion device is pushed in a direction toward the distal end of the first and second guide slots 16, 26, a force is applied directly onto the third panel 30.

When force is applied in the above described manner, a proximal end of the third panel 30 will move away from the hinge member 27, while a distal end of the third panel 30 will move toward the hinge member 27. As more force is applied, the proximal end of the third panel 30 will continue to move away from the hinge member 27 while the distal end of the third panel 30 will continue to move toward the hinge member 27. Thus, the third panel 30 pivots about the pivot point 28 from the non-pivoted position through a series of partially pivoted positions. As shown in FIG. 4, the third panel 30 will move until the actuation guide slot 36 reaches the distal end of the of the aligned first and second guide slots 16, 26. Once the actuation guide slot 36 reaches the distal end of the aligned first and second guide slots 16, 26, the third panel 30 is blocked from moving further. The length of the first and second guide slots 16,26 directly correlate to how far the intermediate apertures 32 are from the blister pocket receiving apertures 12 and exit apertures 22. The length is chosen such that once the third panel 30 is fully pivoted, the intermediate apertures 32 are aligned with the blister pocket receiving apertures 12 and the exit apertures 22. At the point in which the third panel 30 has been fully pivoted, the non-continuous cut line 23 is moved away from the hinge member 27 at an angle 38. Thus, the angle 38 directly correlates to the length of the first and second guide slots 16, 26.

In order to move the third panel 30 back into the partially aligned position of FIG. 3, the steps described above are performed in reverse. The user of the package will apply force to the third panel 30 via the alignment of the guide slots 16, 26, 36 in a direction opposite to the direction applied above. Thus, the actuation guide slot 36 is moved from a distal end to a proximal end of the aligned first and second guide slots 16, 26. As the force is applied to the third panel 30, the distal end of the third panel 30 will move away from bonded portion 27, while the proximal end of the third panel 30 will move toward the bonded portion 27. Once the third panel 30 returns to the partially aligned position, the line 30 is flush against the hinge member 27 such that the angle 38 is substantially 0.

Furthermore, it is preferable that a peripheral edge of the first panel 10 is attached or otherwise sealingly adhered to an opposing peripheral edge of the second panel 20. It is within the scope of the invention for the peripheral edges of the first panel 10 to be sealingly attached to the opposing peripheral edges of the second panel 20, during assembly of the package 1 using an adhesive, supersonic welding, or any other now-known or later discovered technique that is suitable otherwise appropriate to join the opposing surfaces of the panels 10 and 20 together. Additionally, when part of the second panel 20 is folded along the fold line 25, a hinge member 27 is formed. As seen in FIG. 4, the hinge member 27 is a portion of the second panel 20 that is folded on a surface of the second panel 20. The hinge member 27 may be sealingly attached to a surface of the second panel 20 in a manner described above.

The sealed nature of the surfaces of the panels 10 and 20, and the operation of the pivoting third panel 30, deter or otherwise prevent access to the articles contained in the blister packaging, as a child would need to pick or break through the multiple layers formed by the overlapped panels 10, 20 and 30, before encountering the foil or rupturable membrane of the blister package. To access an article held within a particular blister pocket, a user first has to apply force against the third panel 30 via the guide slot arrangement described above. Once the third panel 30 has been fully pivoted, the blister receiving aperture 12, the intermediate aperture 22, and the exit apertures 32 are aligned. Next, the user applies pressure to the blister pocket protruding through the blister pocket receiving aperture 12. The article then passes or breaks through the intermediate aperture 32 of the third panel 30 before passing or breaking through the exit aperture 22 of the second panel 20.

Figures 6, 7:
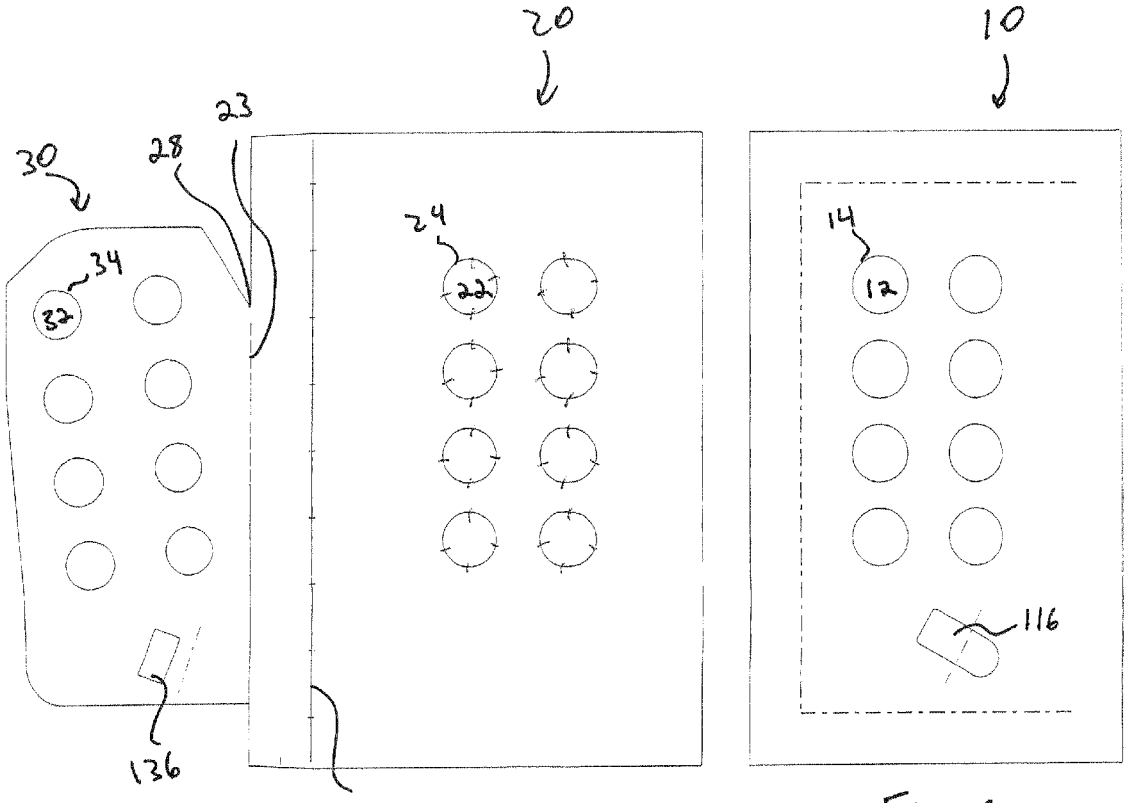
FIG. 6 is a top view of a first panel of a disassembled package according to a second embodiment of the invention.
FIG. 7 is a top view of a second panel and a third panel of the disassembled package of FIG. 6.

FIGS. 6 and 7 illustrate another embodiment of the inventive package, wherein elements that are similar to the embodiments illustrated in FIGS. 1-5 are provided with the same reference numbers, but which a description of is omitted herefrom to avoid redundancy. As shown in FIGS. 6 and 7, the first guide slot 116 and the actuation guide slot 136 are modified, while the guide slot of the second panel 20 is removed.

Referring to FIG. 6, first guide slot 116 has a modified shape capable of receiving a person's finger. In a preferred embodiment, the first guide slot 116 is angled with respect to the non-continuous cut line 23. Referring to FIG. 7, the actuation guide slot 136 has a substantially rectangular shape and is substantially perpendicular to the first guide slot 116. It is within the scope of the invention, however, that the guide slot 116 and the actuation guide slot 136 may be configured to have any suitable shape, and may be oriented relative to the sides of the package 100 in any manner, such as angled, perpendicular, or parallel relative thereto, so long as the orientation allows the actuation guide slot 136 to move along a length of the first guide slot 116. Furthermore, the second panel 20 has no guide slot. As with the first preferred embodiment, the second panel 20 and the third panel 30 is folded onto a surface of the second panel 20 in the same manner described above. Likewise, when the third panel 30 is in a non-pivoted position, the intermediate apertures 32 are partially aligned with the exit apertures 22. As with the first preferred embodiment, when the third panel 30 is pivoted about the pivot point 28, the intermediate apertures 32 fully align with the exit apertures 22. The pivoting motion occurs in the same manner as described above.

Because of the change in configuration of the guide slots 116, 136, the operation of pivoting the third panel 30 is different than in the first preferred embodiment. In the second preferred embodiment, the third guide slot 136 is accessible through the first guide slot 116. However, because there is no guide slot in the second panel 20, a user can simply press a finger or device into the actuation guide slot 136 and push against the perimeter of the guide slot 136. Applying this force will pivot the third panel 30 about the pivot point 28 in the same manner as described in the first preferred embodiment. Once the actuation guide slot 136 reaches the distal end of the first guide slot 116, the user is no longer able to further pivot the third panel 30. As with the first preferred embodiment, a longitudinal axis of the actuation guide slot 136 intersects a longitudinal axis of the first guide slot 116. As shown in FIGS. 6 and 7, in a preferred embodiment, the longitudinal axis of the actuation guide slot 136 is orthogonal relative to a longitudinal axis of the first guide slot 116. It is within the scope of the invention however that the angle of intersection between the actuation guide slot 136 and the first guide slot 116 can be any one of acute, obtuse, or a right angle. As with the first preferred embodiment, once the third panel 30 is fully pivoted, the blister receiving apertures 12, the intermediate apertures 32, and the exit apertures 22, are all aligned with each other. Additionally, the user then applies pressure to the blister pocket protruding through the blister pocket receiving aperture 12. The article then passes or breaks through the intermediate aperture 32 of the third panel 30 before passing or breaking through the exit aperture 22 of the second panel 20.

Figure 8:
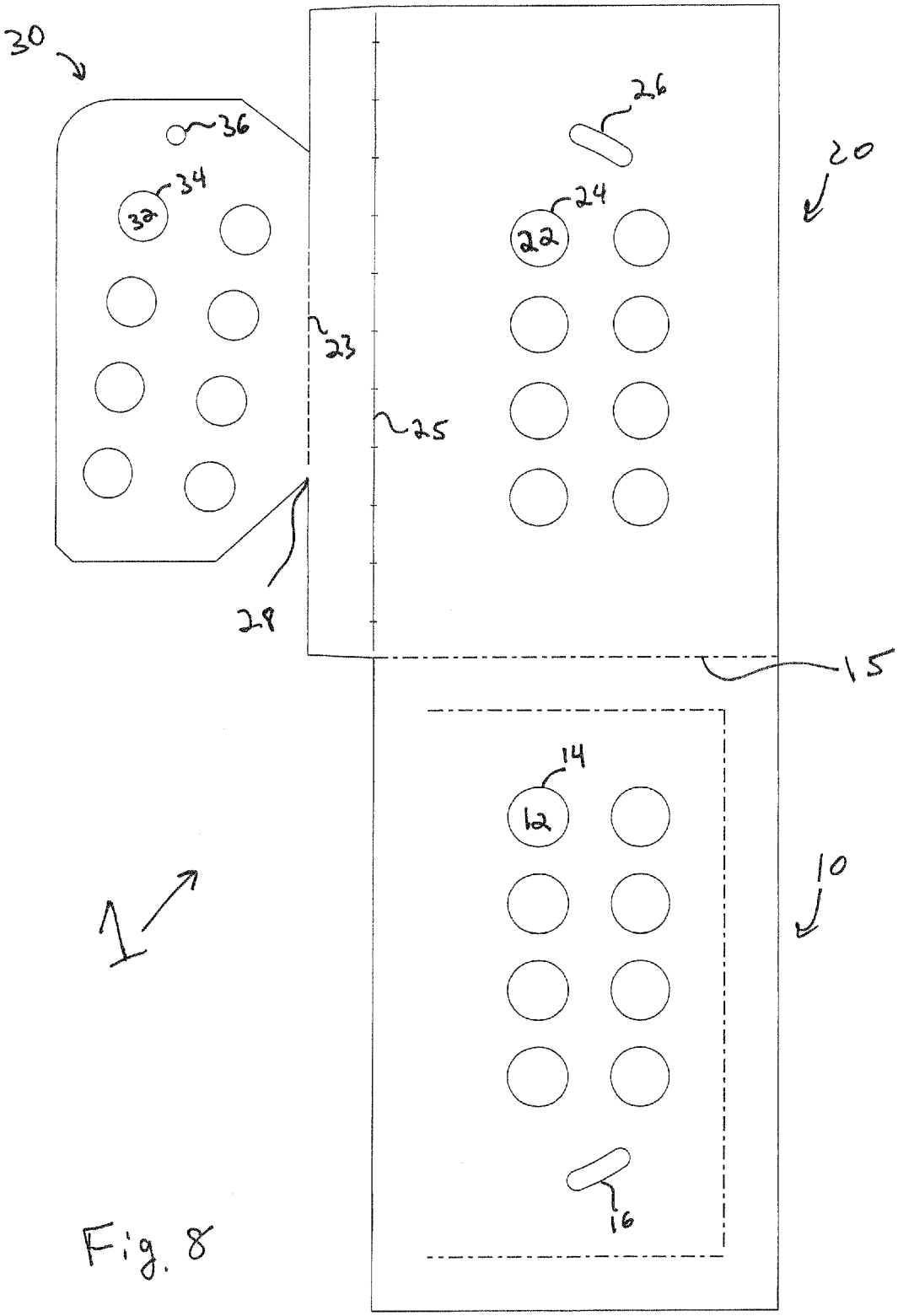
FIG. 8 is a top view of a first panel, a second panel, and a third panel of a disassembled package according to a third embodiment of the invention.

As shown in FIG. 8, in a third preferred embodiment, the first panel 10 may be attached to the second panel 20 on a side different from the side that the third panel 30 is attached. As with the first and second preferred embodiments, the third panel 30 is folded onto the second panel 20 via the fold line 25. The first panel 10 is then folded on top of the third and second panels 30, 20, via the fold line 15. Thus, the third preferred embodiment results in a similar structure as the above described embodiments. When viewed from the side, the intermediate apertures 32 are located between the blister pocket receiving and exit apertures 12 and 22, respectively. This preferred embodiment may be applied to either of the first and second preferred embodiments described above. Furthermore, by folding the first panel 10 onto the second and third panels 20, 30, an additional level of child protection is obtained because the folding makes it more difficult to break apart the layers.

Figure 9:
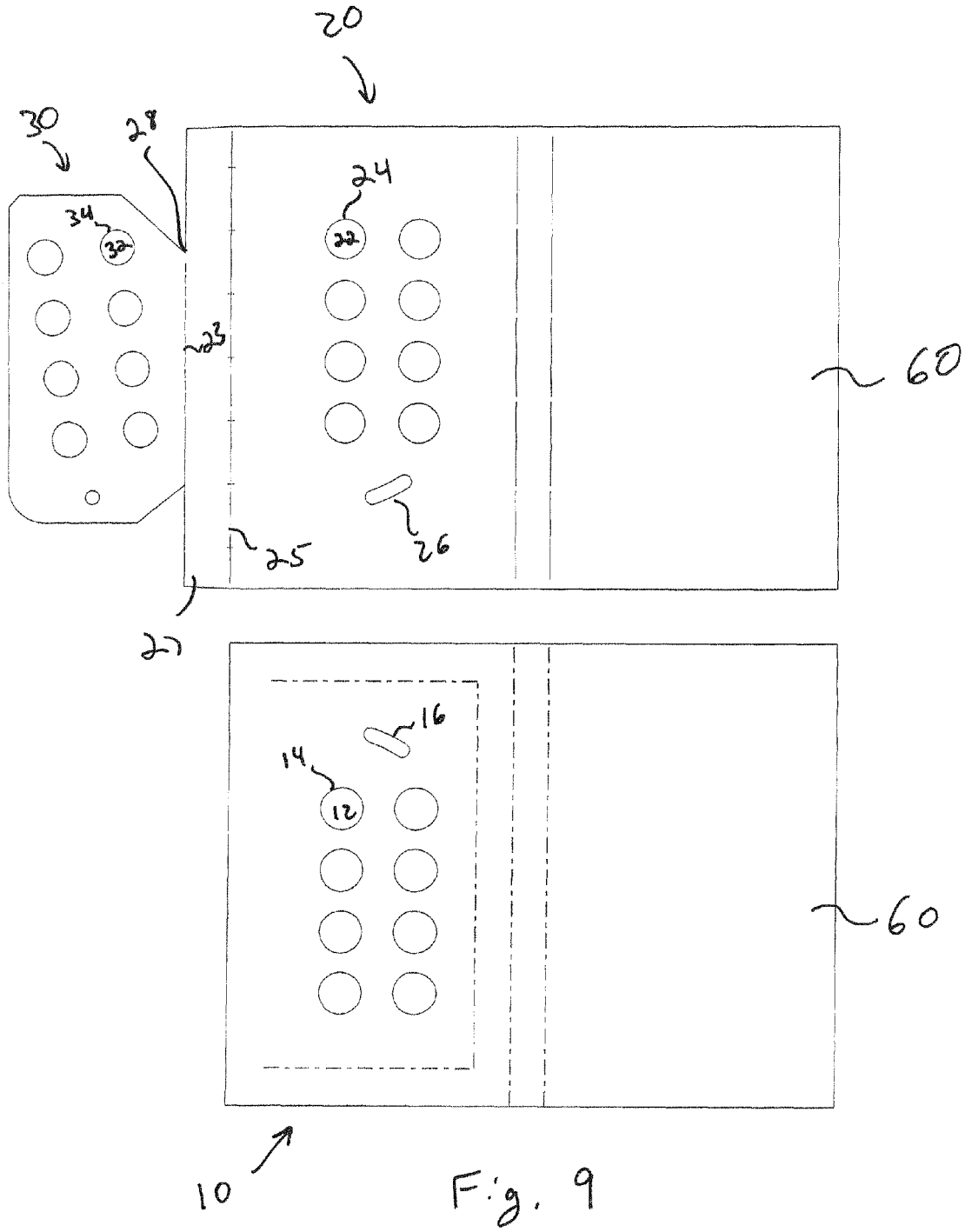
FIG. 9 is a top view of a first panel, a second panel, and a third panel of a disassembled package according to a fourth embodiment of the invention.

FIG. 9 shows a fourth preferred embodiment where the first panel and the second panel additionally include graphic panels 60. The graphic panels 60 may display information including what article is enclosed in the blister package as well as dosages, instructions, or any other information.

As described above, it should be noted that it is within the scope of this invention for the apertures 12, 22 and 32 to be any geometric shape that will facilitate passage of the articles therethrough. For example only, although not illustrated but well known in the art, the apertures can be oblong, rectangular, square, trapezoidal, triangular, and the like.

The above described structural configurations of the packages provide a package that is easy to use by adults yet prevents unwanted access to the articles therein by children.

Many modifications may be made to adapt the teachings of the package of this invention to particular situations or materials without departing from the scope thereof. For example, as described above, the second panel 20 and the third panel 30 may have apertures 22 and 32, respectively, defined by nicked lines instead of cut-lines. Furthermore, while in a preferred embodiment the first panel 10 is described above as being bonded to the second panel 20 on all four sides of the package to provide tamper protection, any joining system or method that would secure the panels together is suitable and considered within the scope of the invention. For example, the package may be bonded only along one of the widths (top or bottom) and one of the lengths (left side or right side), leaving the remaining two sides unbonded. Alternatively, only the lengths (left side and ride side) may be bonded, leaving the widths (top and bottom) unbonded. Additionally, only the widths may be bonded (top and bottom), leaving the lengths (left side and right side) unbonded. This invention should not be limited to the particular embodiments disclosed herein, but includes all embodiments within the spirit and scope of the disclosure.

What is claimed is:

1. A multi-layered blister package comprising:

a first panel having at least one blister pocket receiving aperture and a first guide slot defined therein, wherein a blister pocket is aligned with the at least one blister pocket receiving aperture and retains an article therein;

a second panel having at least one exit aperture defined therein;

a third panel disposed between the first panel and the second panel, the third panel having at least one intermediate aperture and an actuation guide slot defined therein;

a pivot point connecting the third panel to the second panel, wherein the third panel is pivotable about the pivot point and relative to at least one of the first and second panels;

wherein the third panel, via the actuation guide slot and the first guide slot, is configured to pivot about the pivot point while disposed between the first panel and the second panel.

2. The package according to claim 1, wherein the third panel is configured to pivot about the pivot point from a first position to a second position, wherein the first position is a non-aligned position wherein a center point of the at least one intermediate aperture is substantially not aligned with a center point of the at least one blister pocket receiving aperture and a center point of the at least one exit aperture, and wherein the second position is an aligned position wherein the center point of the at least one intermediate aperture is substantially aligned with the center point of the at least one blister pocket receiving aperture and the center point of the at least one exit aperture.

3. The package according to claim 1, wherein the second panel comprises:

a fold line and a hinge member, wherein the hinge member is folded over the fold line onto a surface of the second panel.

4. The package according to claim 3, wherein the third panel is pivotally connected to the hinge member via the pivot point.

5. The package according to claim 3, wherein the first panel is joined to a surface of the hinge member.

6. The package according to claim 3, wherein the second panel comprises a second guide slot defined therein.

7. The package according to claim 6, wherein the first guide slot and the second guide slot define areas larger than the actuation guide slot.

8. The package according to claim 6, wherein the actuation guide slot is disposed between the first guide slot and the second guide slot.

9. The package according to claim 7, wherein the first guide slot and the second guide slot are angled with respect to the fold line.

10. The package according to claim 9, wherein the first guide slot and the second guide slot have an arcuate shape and are in an overlapping arrangement with each other when the first panel is positioned over the second panel.

11. The package according to claim 10, wherein the actuation guide slot is a circle having a diameter substantially equal to a width of the first and second guide slots.

12. The package according to claim 2, wherein, when the third panel is in the first position, the actuation guide slot is disposed at a proximal end of the first guide slot, and when the third panel is in the second position, the actuation guide slot is disposed at a distal end of the first guide slot.

13. The package according to claim 1, wherein a longitudinal axis of the actuation guide slot intersects a longitudinal axis of the first guide slot.

14. The package according to claim 1, wherein the first panel, the second panel, and the third panel are formed of a single piece.

15. The package of claim 12, wherein the first panel is attached to the second panel via the fold line.

16. The package of claim 1, wherein the first panel is joined to the second panel along a periphery of the first and second panels.

17. The package of claim 13, wherein an angle defined by the intersecting longitudinal axis of the actuation guide slot and the longitudinal axis of the first guide slot is acute.

18. The package of claim 13, wherein an angle defined by the intersecting longitudinal axis of the actuation guide slot and the longitudinal axis of the first guide slot is obtuse.

19. The package of claim 13, wherein the longitudinal axis of the actuation guide slot is orthogonal relative to the longitudinal axis of the first guide slot.

20. The package of claim 1, wherein the actuation slot is configured to align within a portion of the first guide slot when the third panel is pivoted about the pivot point.

* * * * *